US011473546B2

(12) United States Patent
Kirk et al.

(10) Patent No.: US 11,473,546 B2
(45) Date of Patent: Oct. 18, 2022

(54) VEHICLE STARTER WITH INTEGRATED THERMAL PROTECTION

(71) Applicant: BorgWarner Inc., Auburn Hills, MI (US)

(72) Inventors: Michael E. Kirk, Anderson, IN (US); William P. Whitlock, Jr., Cicero, IN (US); Randy L. Andis, Anderson, IN (US); Rodney E. Spangler, Anderson, IN (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 17/117,726

(22) Filed: Dec. 10, 2020

(65) Prior Publication Data

US 2021/0190027 A1 Jun. 24, 2021

Related U.S. Application Data

(60) Provisional application No. 62/950,568, filed on Dec. 19, 2019.

(51) Int. Cl.
*F02N 11/10* (2006.01)
*F02N 15/06* (2006.01)
(Continued)

(52) U.S. Cl.
CPC ..... *F02N 15/067* (2013.01); *F02N 11/087* (2013.01); *F02N 11/10* (2013.01); *H01H 51/065* (2013.01)

(58) Field of Classification Search
CPC ..... F02N 11/10; F02N 11/087; F02N 11/101; F02N 11/105; F02N 11/106; F02N 15/067; H01H 47/26; H01H 51/065
See application file for complete search history.

(56) References Cited

U.S. PATENT DOCUMENTS 2,356,063 A * 8/1944 Dermond ..... F02N 19/001 123/179.16
4,200,080 A 4/1980 Cook et al.
(Continued)

FOREIGN PATENT DOCUMENTS

JP 2001-329932 A 11/2001
JP 2014-92114 A 5/2014

OTHER PUBLICATIONS

International Search Report and Written Opinion of the International Searching Authority, PCT/US2020/064211, dated Mar. 29, 2021, 12 pages.

*Primary Examiner* — Lindsay M Low
*Assistant Examiner* — Arnold Castro
(74) *Attorney, Agent, or Firm* — Bose McKinney & Evans LLP

(57) ABSTRACT

A starter assembly which includes a switch for energizing a solenoid. Energizing the solenoid biases a starter gear into engagement and energizes the starter motor. A thermally responsive switch is positioned to absorb heat generated by operation of the electric motor and is disposed in an electrical line controlling operation of the switch controlling the solenoid wherein opening of the thermally responsive switch results in the opening of the solenoid switch. The use of such a thermally responsive switch de-energizes the electric motor when the electric motor is subjected to elevated operating temperatures that might otherwise cause damage to the electric motor. The starter assembly may also include control circuitry that includes a microprocessor wherein the control circuitry is operably coupled with the switch controlling the solenoid. The control circuitry is programmed to de-energize the solenoid upon the satisfaction of predetermined conditions to thereby prevent damage to the electrical motor.

16 Claims, 8 Drawing Sheets

(51) Int. Cl.
*H01H 51/06* (2006.01)
*F02N 11/08* (2006.01)

(56) References Cited

U.S. PATENT DOCUMENTS

| | | | | |
|---|---|---|---|---|
| 7,209,337 | B2 | 4/2007 | Bradfield et al. | |
| 9,234,803 | B2 | 1/2016 | Cheng et al. | |
| 10,082,122 | B2 | 9/2018 | Kirk | |
| 2014/0238343 | A1 | 8/2014 | Groh et al. | |
| 2018/0283341 | A1* | 10/2018 | Greene | F02N 11/106 |

* cited by examiner

SMART IMS Initial Program Setting

| Feature & Benefit | Prevented Failure Mode | Program Setting - 24V System | Program Setting - 12V System | Sensing Point |
|---|---|---|---|---|
| **Rapid re-engagement lockout** | Damaged pinion & ring gear teeth | Timer circuit<br>3 sec delay to re-energize IMS | Timer circuit<br>3 sec delay to re-energize IMS | **S+ Terminal** |
| **Running engine lockout** | Engagement into running engine / damaged pinion & ring gear teeth | Sense B+ voltage<br>Lock-out ≥ 27.5V - engine running / alternator charging | Sense B+ voltage<br>Lock-out ≥ 14V - engine running / alternator charging | **B+ Terminal** |
| **Low voltage lock-out** | Overcrank / solenoid chatter | Sense B+ voltage<br>1) Start attempt not allowed if OCV is ≤ 24.0V<br>2) Start attempt aborted if voltage drops below 8.0V (1st 80ms) during crank | Sense B+ voltage<br>1) Start attempt not allowed if OCV is ≤ 12.0V<br>2) Start attempt aborted if voltage drops below 4.5V (1st 80ms) during crank | **B+ Terminal** |
| **Time Limited Crank** | Overcrank | Timer circuit<br>Maximum 20 sec crank w/ 10 sec delay between attempts (alternate on / off times available depending on application needs or customer requirements). | Timer circuit<br>Maximum 20 sec crank w/ 10 sec delay between attempts (alternate on / off times available depending on application needs or customer requirements). | **S+ Terminal or M terminal** |
| **Engagement Monitor I Auto-retry** | Click-no-Crank (driver annoyance)<br>Solenoid prolonged power | Sense M-terminal voltage<br>-Auto Retry for Click No Crank – if M-terminal < 6.0V in 150ms; power off coil 40~60ms and re-energize coil 140~160ms.<br>- Limit to 3 consecutive auto-retry events | Sense M-terminal voltage<br>- Auto Retry for Click No Crank - if M-terminal < 4.5V in 150ms; power off coil 40~60ms and re-energize coil 140~160ms.<br>- Limit to 3 consecutive auto-retry events | **M Terminal** |
| **Auto-disengage at engine start** | Extended overrun | **Sense IMS S-terminal voltage**<br>IMS de-energized when S-terminal voltage rebounds to 25V for 800 loops (460ms-0.579ms/cycle) to turn off MOSFET to stop cranking | **Sense IMS S-terminal voltage**<br>IMS de-energized when S-terminal voltage rebounds to 11.5V for 800 loops (460ms - 0.579ms/cycle) to turn off MOSFET to stop cranking | **S-Terminal** |

FIG. 10

VEHICLE STARTER WITH INTEGRATED THERMAL PROTECTION

CROSS REFERENCE TO RELATED APPLICATIONS

This application claims priority under 35 U.S.C. 119(e) of U.S. provisional patent application Ser. No. 62/950,568 filed on Dec. 19, 2019 entitled VEHICLE STARTER WITH INTEGRATED THERMAL PROTECTION the disclosure of which is hereby incorporated herein by reference.

BACKGROUND

1. Technical Field

The present disclosure relates to starter systems for internal combustion engines and is particularly relevant to starter systems for commercial vehicles and other large applications.

2. Description of the Related Art

There have been many recent significant developments in starter systems for passenger vehicles. For example, it is now common for an electronic control unit (ECU) of such passenger vehicles to stop the engine and subsequently and automatically actuate the vehicle starter to restart the vehicle. In such vehicles where the ECU of the vehicle controls the operation of the starter system, the ECU may be programmed to limit or prevent damage to the starter system due to various operator actions.

Commercial vehicles and equipment such as the semi-truck of a tractor-trailer combination, heavy equipment, commercial buses and other large vehicles as well as large stationary generator sets often utilize a less sophisticated starter system. The manufacturers of such large vehicles and equipment often source the engine from a separate manufacturer. The engine manufacturer often designs such engines for wide applicability instead of for a single application. As a result, the engine manufacturers will often provide a relatively simple starting system. Many such starter systems are susceptible to thermal damage due to misuse by the operator of the vehicle/application.

There remains a need for cost-effective solutions which limit or prevent the possibility of harm to the starting system due to user misuse in such starting systems.

SUMMARY

The present disclosure provides a cost-effective starting motor assembly which can limit damage to the starting system due to operator misuse and without requiring the vehicle to have a special wiring harness.

The invention provides, in some embodiments thereof, a starter assembly for an internal combustion engine wherein the starter assembly is adapted to work with a voltage source and the internal combustion engine to start the engine and the starter assembly includes an electric motor which drives a starter gear. The starter gear is selectively shiftable between an engaged position and a disengaged position wherein in the starter gear is operably coupled with the internal combustion engine in the engaged position and is decoupled from the internal combustion engine in the disengaged position. A solenoid is coupled with the starter gear wherein energizing the solenoid shifts the starter gear into the engaged position and wherein the starter gear is biased to the disengaged position when the solenoid is de-energized. Energizing the solenoid also closes a motor switch. The motor switch is disposed in a first electrical line adapted to couple the electric motor with the voltage source whereby closing the motor switch energizes the electric motor and opening the motor switch de-energizes the electric motor. A solenoid switch is disposed in a second electrical line in communication with the solenoid wherein closing the solenoid switch energizes the solenoid and opening the solenoid switch de-energizes the solenoid. A thermally responsive switch is positioned to absorb heat generated by operation of the electric motor wherein the thermally responsive switch opens when experiencing elevated temperatures. The thermally responsive switch is disposed in a third electrical line operably coupled with the solenoid switch (e.g., the third line may form the coils of a solenoid switch formed by a magnetic switch) wherein energizing the third electrical line closes the solenoid switch and de-energizing the third electrical line opens the solenoid switch, and wherein the third electrical line is grounded by attachment to the starter assembly, the thermally responsive switch being disposed in the third electrical line between the solenoid switch and the ground location wherein opening of the thermally responsive switch prevents energizing of the third electrical line and results in the opening of the solenoid switch. The use of such a thermally responsive switch de-energizes the electric motor when the electric motor is subjected to elevated operating temperatures that might otherwise cause damage to the electric motor.

In some embodiments, the third electrical line also includes a user operated switch. Such a user operated switch may take the form of a switch operated by an ignition key. In such embodiments, the solenoid switch may take the form of a magnetic switch. In such embodiments, the third electrical line may extend, in series, from the voltage source to the user operated switch, to the magnetic switch, to the thermally responsive switch, to a ground. In still further variations, the electric motor may be mounted within a main housing wherein the main housing is grounded, and wherein the magnetic switch is disposed in a switch housing, the switch housing being mounted on and electrically isolated from the main housing and wherein the third electrical line is grounded by connecting it to the main housing, the thermally responsive switch being disposed in the third line between the switch housing and the main housing.

In other embodiments, the thermally responsive switch may take the form of a bimetallic switch.

In some embodiments, the thermally responsive switch is mounted on and absorbs heat from the brush plate assembly of the electric motor.

Combining various features of the embodiments mentioned above, in some embodiments, the thermally responsive switch is a bimetallic switch disposed in a third electrical line wherein the third electrical line also includes a user operated switch, the solenoid switch is a magnetic switch and the third electrical line extends, in series, from the voltage source to the user operated switch, to the magnetic switch, to the thermally responsive switch, to a ground. The electric motor in such an embodiment may be mounted within a main housing, the main housing being grounded, with the magnetic switch being disposed in a switch housing, the switch housing being mounted on and electrically isolated from the main housing and wherein the third electrical line is grounded by connecting it to the main housing, the thermally responsive switch being disposed in the third line between the switch housing and the main housing and wherein the solenoid is also supported on the main housing. Such an embodiment may require that the user operated switch is closed to close the solenoid switch.

In any one of the embodiments discussed above, the starter assembly may also include control circuitry that includes a microprocessor wherein the control circuitry is operably coupled with the solenoid switch. The control circuitry is in communication with a motor voltage sensing line whereby the control circuitry is responsive to voltage changes in the electrical motor. The control circuitry is also in communication with an electrical line in communication with the voltage source whereby the control circuitry is responsive to the voltage of the voltage source. The control circuitry is programmed to open the solenoid switch upon the satisfaction of predetermined conditions to thereby prevent damage to the electrical motor.

In some embodiments including control circuitry, the control circuitry includes a MOSFET switch with the MOSFET switch being disposed in the electrical line controlling operation of the solenoid switch wherein opening of the thermally responsive switch results in the opening of the solenoid switch, the MOSFET switch being disposed in series with the thermally responsive switch. In such an embodiment having a MOSFET switch, the circuitry is advantageously arranged such that the thermally responsive switch is still operable to open the electrical line controlling the operation of the solenoid switch in the event of a short circuit of the MOSFET switch to a closed configuration.

In embodiments including control circuitry, the control circuitry may be programmed to:

a) require a delay between sequential closings of the solenoid switch of at least three seconds (to thereby provide a rapid re-engagement lockout);

b) prevent the closing of the solenoid switch when the voltage of the voltage source exceeds a predetermined engine running voltage threshold (to thereby provide an engine running lockout);

c) prevent the closing of the solenoid switch if the voltage of the voltage source falls below a predefined first low voltage threshold (to thereby provide a low voltage lockout);

d) open the solenoid switch if the voltage of the voltage source falls below a predefined second low voltage threshold, the second low voltage threshold being lower than the first low voltage threshold (to thereby provide a low voltage lockout);

e) open the solenoid switch after passage of a predetermined time limit with the solenoid switch closed (to thereby provide a time-limited-crank function);

f) wherein the thermally responsive switch is disposed in a third electrical line and wherein the third electrical line also includes a user operated switch and, when the user operated switch is closed and the voltage of the electric motor falls below a predetermined threshold, the solenoid switch is momentarily opened and then closed and, if the voltage of the electric motor does not rise above the predetermined threshold and three such sequential opening and closing of the solenoid switch are conducted, the solenoid switch is opened (to thereby provide an auto-retry function); and g) wherein the control circuitry is responsive to the voltage in an electrical line containing the user operated switch and the solenoid switch is opened if, after closing the solenoid switch and energizing the solenoid, the voltage of the electrical line containing the user-operated switch rebounds above a predetermined threshold (to thereby provide an auto-disengage at start function).

In the various embodiments including control circuitry, the control circuitry may be mounted within a control unit housing with the control unit housing being attached to the switch housing. A vibrational dampening and electrically isolating mounting assembly may be used to secure the control unit housing and the switch housing to the main housing wherein the mounting assembly electrically isolates the main housing from the control unit housing and from the switch housing.

In any of the embodiments described above, the user operated switch may be required to be closed to close the solenoid switch as is required in some less sophisticated starter systems.

BRIEF DESCRIPTION OF THE DRAWINGS

The above mentioned and other features of this invention, and the manner of attaining them, will become more apparent and the invention itself will be better understood by reference to the following description of embodiments of the invention taken in conjunction with the accompanying drawings, wherein:

FIG. 10 is a chart of control circuitry logic for the starter assembly of FIG. 5 which may be conveniently adapted for a variety of different applications.

Figure 1:
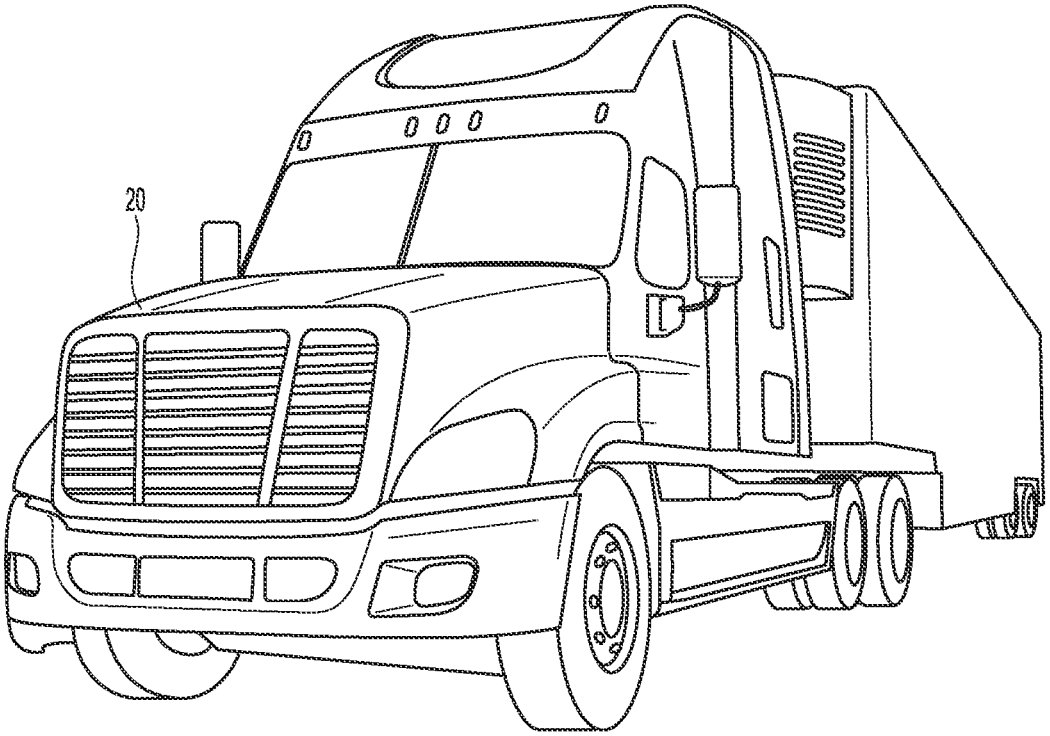
FIG. 1 is a view of a vehicle employing a starting assembly as described herein.

Corresponding reference characters indicate corresponding parts throughout the several views. Although the exemplification set out herein illustrates several embodiments of the invention, in various forms, the embodiments disclosed below are not intended to be exhaustive or to be construed as limiting the scope of the invention to the precise forms disclosed.

DETAILED DESCRIPTION

One example of a vehicle 20 in which a starter assembly 22 as described herein can be used is shown in FIG. 1. The illustrated vehicle 20 is a semi-truck and forms part of a tractor-trailer combination. Starter assembly 22 may also be used in other commercial vehicles such as buses, agricultural equipment, industrial and construction equipment, and similar large vehicles. It may also be employed with large generator sets and other stationary equipment. While starter assembly 22 is particularly well-suited for use with large equipment and vehicles, it may also be employed with smaller vehicles and equipment having internal combustion engines.

Figure 2:
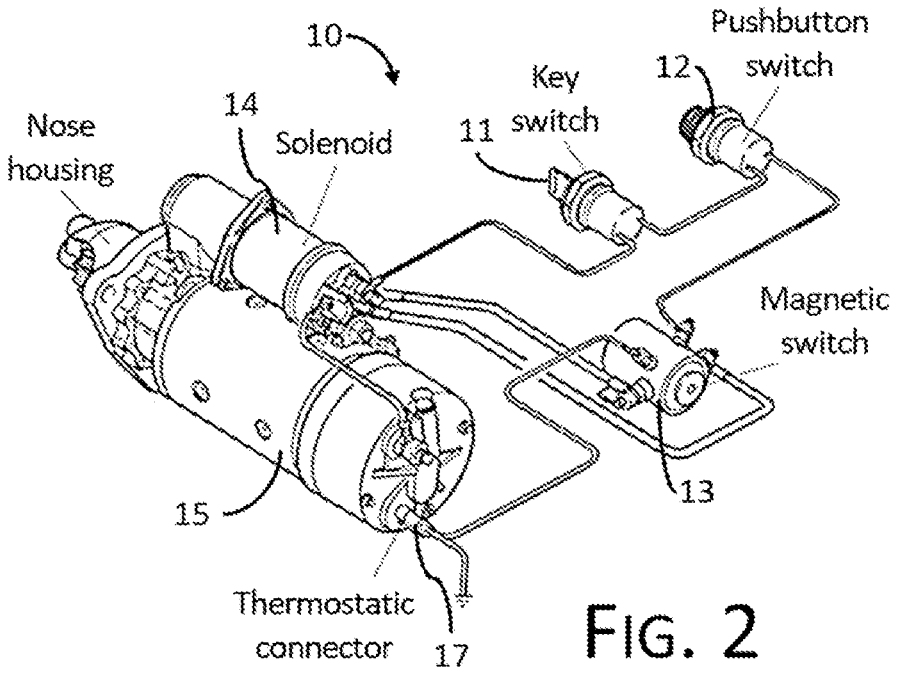
FIG. 2 (PRIOR ART)
FIG. 2 is a schematic view of a prior art system having a thermally responsive switch.
Figure 3:
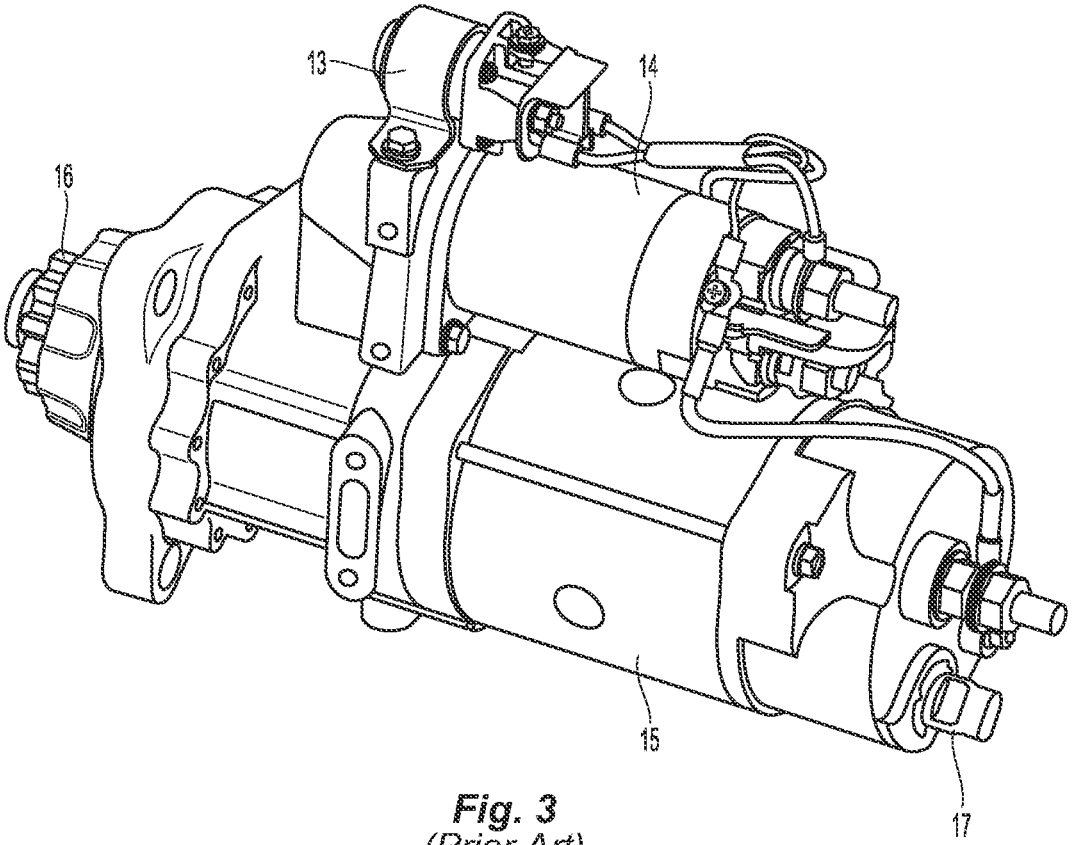
Fig. 3 (Prior Art)
FIG. 3 is a perspective view of a prior art starter assembly having a thermally responsive switch.

FIG. 2 illustrates a prior art starter system 10. System 10 includes two user-operated switches, a key switch 11 and a pushbutton ignition switch 12. After turning the key switch 11 to a closed or on position, the push button switch 12 can be actuated/closed to initiate a starting sequence. When both switches 11, 12 are closed, this causes magnetic switch 13 to close which energizes solenoid 14. It is noted that FIG. 2 shows the magnetic switch 13 located separate from the starter assembly while FIG. 3 illustrates a starter assembly wherein the magnetic switch 13 is mounted on the main housing of the starter assembly.

Energizing solenoid 14 energizes starting motor 15 and biases a pinion gear 16 into engagement with a ring gear on the internal combustion engine when starting the engine. Also included in the starter system 10 is a thermostatic connector 17 which provides a thermally responsive switch to de-energize the starter motor 15 if it becomes overheated. The thermally responsive switch is disposed in an electrical line connecting the starting motor 15 to ground. The thermostatic connector 17 is a non-standard two pin connector used to form the ground terminal of the starter assembly. A standard ground connection would be a single pin connector and use of the thermostatic connector 17 requires the wiring harness of the vehicle be specifically modified for use with the starter assembly having such thermostatic connector 17.

Figure 4:
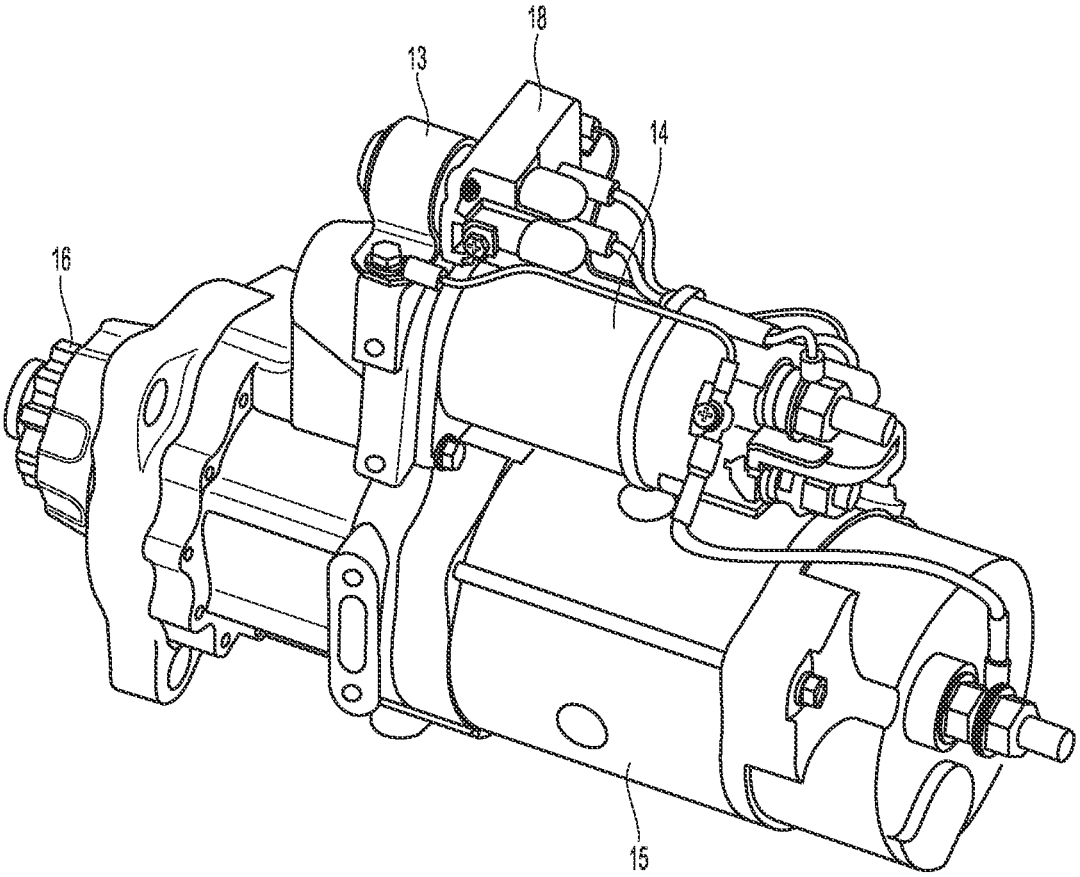
Fig. 4 (Prior Art)
FIG. 4 is a perspective view of a prior art starter assembly having a microcontroller for controlling the operation of a magnetic switch.

FIG. 4 illustrates another example of a prior art starter assembly. The starter assembly of FIG. 4 does not include a thermostatic connector 17 or thermally responsive switch. Instead, the assembly of FIG. 4 includes control circuitry 18 which is programmed with logic to limit damage to the starter assembly and is similar to the starter assemblies disclosed in U.S. Pat. No. 10,082,122, the disclosure of which is incorporated herein by reference.

Figure 5:
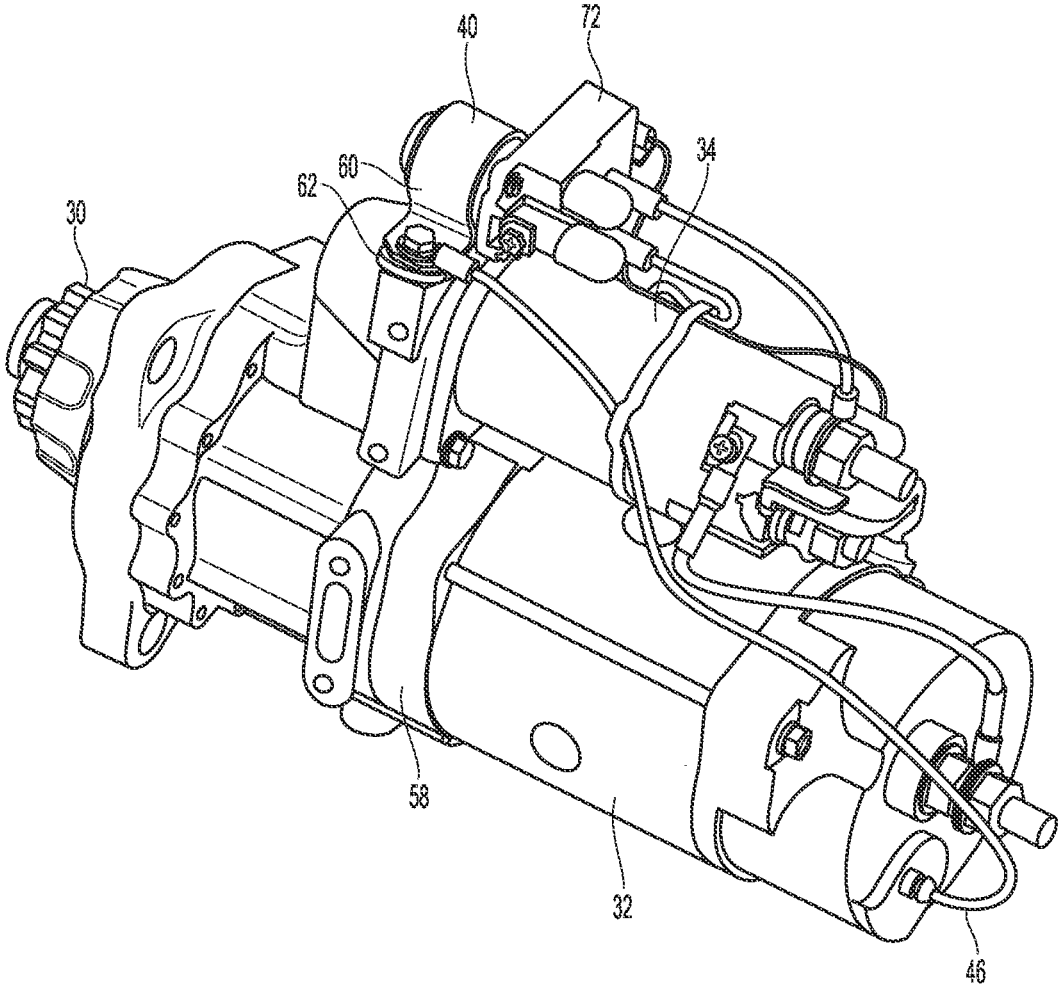
FIG. 5 is a perspective view of a starter assembly having integrated thermal protective features.
Figure 8:
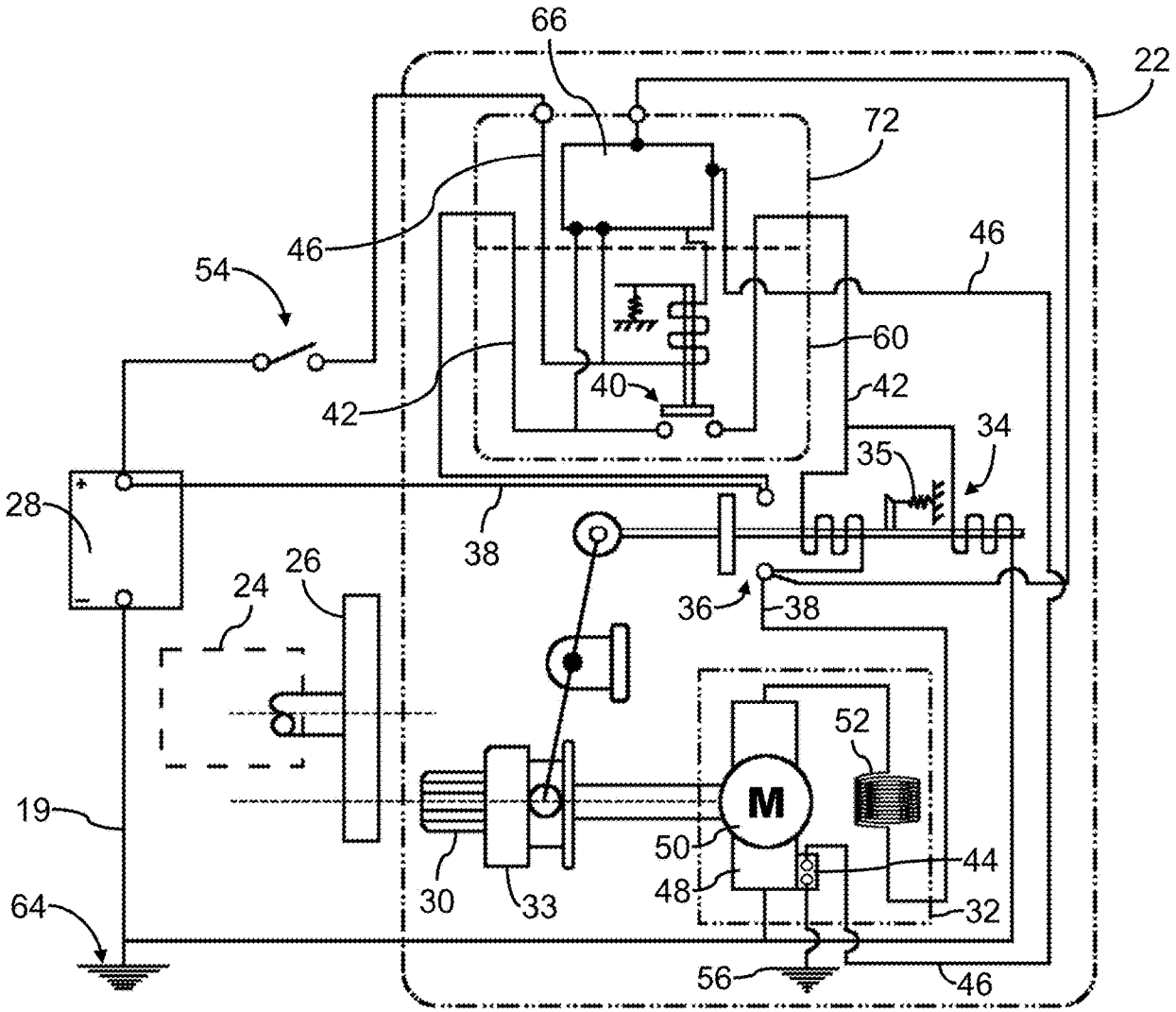
FIG. 8 is a schematic view of a starter system which includes the starter assembly of FIG. 5.

A starter assembly 22 is shown in FIG. 5 which provides the advantages of using a thermally responsive switch similar to the starter assembly depicted in FIGS. 2 and 3 and the advantages of using control circuitry similar to the starter assembly depicted in FIG. 4 while overcoming several disadvantages of these prior art starter assemblies as will be discussed in the description which follows. A schematic depiction of a starter system having a starter assembly 22 is shown in FIG. 8.

Starter assembly 22 is used when starting an internal combustion engine 24. Starter assembly 22 is selectively coupled to the engine 24 by engaging a starter gear 30, in the form of a pinion gear in the illustrated embodiment, with a ring gear 26 of the engine 24. A voltage source 28, such as the battery pack of a vehicle, is used to power an electric motor 32 that forms the starter motor. When starting engine 24, starter gear 30 is engaged with ring gear 26 and electric motor 32, powered by voltage source 28, rotatably drives starter gear 30 which, in turn, drives ring gear 26 to start engine 24.

It is noted that electric motor 32 is formed by an electric machine that is used as a motor when starting engine 24. In some embodiments, this electric machine may be operable as only an electric motor while in others, it may be selectively operable as either an electric motor or a generator. The use of the term "motor" when referring to this electric machine does not imply that it is capable of only operating as a motor and may also be used herein to refer to an electric machine capable of operating as a generator.

Starter gear 30 is moveable between an engaged position, where it is engaged with ring gear 26, and a disengaged position, where it is disengaged from ring gear 26, whereby the starter gear 30 and electric motor 32 are operably coupled with internal combustion engine 24 in the engaged position and is decoupled from the internal combustion engine 24 in the disengaged position.

An overrunning clutch 33 is disposed between starter gear 30 and electric motor 32 so that if gear 30 remains engaged with ring gear 26 after starting engine 24, the resulting excessive rotational speed of starter gear 30 will not be transmitted back to electric motor 32. The use of such overrunning clutches in a starter assembly is well-known to those having ordinary skill in the art.

A solenoid 34 is coupled with the starter gear 30 such that energizing solenoid 34 shifts the starter gear 30 into the engaged position. Starter gear 30 is biased towards the disengaged position with spring 35 and when solenoid 34 is de-energized, starter gear 30 moves to its disengaged position.

Energizing solenoid 34 also closes a switch 36 referred to herein as a motor switch because it controls the energization of electric motor 32. Motor switch 36 is disposed in an electrical line 38 which couples electric motor 32 with voltage source 28 whereby closing motor switch 36 energizes electric motor 32 and opening motor switch 36 de-energizes electric motor 32. This use of a solenoid to control the shifting of a starter gear into and out of engagement with an engine ring gear and operation of a switch for energizing of the starter motor is well-known to those having ordinary skill in the art.

Switch 40 is referred to herein as a solenoid switch because it controls the energization of solenoid 34. Solenoid switch 40 is disposed in an electrical line 42 in communication with the solenoid wherein closing solenoid switch 40 energizes solenoid 34 and opening solenoid switch 40 de-energizes solenoid 34. In the illustrated embodiment, solenoid switch 40 is a magnetic switch having coils 41 and a plunger. When coils 41 are energized, the coils move the plunger to close switch 40, when coils 41 are not energized, the plunger is biased by a spring to a position wherein switch 40 is opened. The use of a magnetic switch to control the energization of a starter solenoid is well-known to those having ordinary skill in the art.

A thermally responsive switch 44 is positioned to absorb heat generated by operation of electric motor 32 such that thermally responsive switch 44 opens when experiencing elevated temperatures. Thermally responsive switch 44 is disposed in an electrical line 46 controlling operation of solenoid switch 40 wherein opening of thermally responsive switch 44 results in the opening of solenoid switch 40. As a result, thermally responsive switch 44 de-energizes electric motor 32 when electric motor 32 is subjected to elevated operating temperatures that might otherwise cause damage to electric motor 32.

In the illustrated embodiment, thermally responsive switch 44 is a bimetallic switch. A suitable example of such a bimetallic switch is disclosed in U.S. Pat. No. 7,209,337 issued on Apr. 24, 2007 to Bradfield et al. entitled Electrical Thermal Overstress Protection Device, the disclosure of which is incorporated herein by reference.

In the illustrated embodiment, electric motor 32 is a direct current (DC) motor with a brush plate assembly 48 communicating electrical current with rotor 50 and a stator 52 which takes the form of a field coil. Brush plate assembly 48, rotor 50 and stator 52 operate in a manner well known to those having ordinary skill in the art.

Thermally responsive switch 44 is mounted on and absorbs heat from the brush plate assembly 48 of electric motor 32. Brush plate assembly 48 communicates electrical current with rotor 50 during operation of electric motor 32 and will experience elevated temperatures in the event of overheating of electric motor 32. Although brush plate assembly 48 is used as the mounting location for thermally responsive switch 44 in the illustrated embodiment, switch 44 could be mounted in any number of alternative locations provided that such locations will convey thermal energy to switch 44 in a manner that allows switch 44 to sense thermal energy representative of the operating temperature of electric motor 32. For example, switch 44 could alternatively be mounted on stator 52, on a part in thermal communication with rotor 50 or stator 52, or, in close proximity to rotor 50 or stator 52.

It is noted that mounting thermally responsive switch 44 on brush plate assembly describes the physical location of switch 44 and switch 44 will be responsive to the temperature at this physical location. Mounting thermally responsive switch 44 at this location does not mean that this switch controls the electrical current being transferred by brush plate assembly 48.

As mentioned above, thermally responsive switch 44 is disposed in electrical line 46 in the illustrated embodiment and when thermally responsive switch 44 is open, solenoid switch 40 will also be open thereby resulting in starter gear 30 moving towards its disengaged position and de-energizing of electric motor 32. Electrical line 46 includes a user operated switch 54 which may take the form of switch operated by an ignition key.

As can be seen in FIG. 8, electrical line 46 extends, in series, from voltage source 28 to user operated switch 54, to solenoid switch 40, to thermally responsive switch 44, to a ground 56. As can also be seen in FIG. 8, electrical line 46 forms the coil of the magnetic switch forming solenoid switch 40. Thus, when electrical line 46 has current flowing through it, the coil of switch 40 will be energized and close solenoid switch 40. It is also noted that solenoid switch 40 does not open or close electrical line 46 but electrical line 42 which forms coils of solenoid 34 whereby current flowing through line 42 energizes solenoid 34 and thereby closes motor switch 36 and shifts starter gear 30 into engagement with ring gear 26.

Although only a single user-operated switch 54 is used in the starter system depicted in FIG. 8, alternative embodiments might employ a plurality of such user-operated switches. For example, an alternative embodiment might employ both a key-operated switch and a push button switch arranged in series where both of these user-operated switches must be closed to close solenoid switch 40.

In the illustrated embodiment, electric motor 32 is mounted within a main housing 58 which is grounded by attachment to the vehicle frame. Thus, for those components of starter assembly that require electrical grounding, such grounding may be accomplished by attachment to main housing 58.

The grounding of a starter motor housing by attaching the housing to the frame of the vehicle is well-known in the art. For the prior art embodiment depicted in FIGS. 3 and 4, the starter motor housing is electrically grounded and the ground for the magnetic switch is accomplished by attaching the line to a housing of the magnetic switch and then attaching that magnetic switch housing directly to the main housing of the starter motor.

The grounding of the solenoid switch 40 of the embodiment of FIGS. 5 and 8 is accomplished differently than that of the starter assemblies depicted in FIGS. 3 and 4. For the embodiment of FIGS. 5 and 8, the solenoid switch 40 is grounded through thermally responsive switch 44 as mentioned above. The solenoid switch 40, in the form of a magnetic switch, is disposed within a switch housing 60 and line 46 is attached to switch housing 60. Switch housing 60, however, is electrically isolated from main housing 58 and an extension of line 46 attached to the exterior of switch housing 60 extends to thermally responsive switch 44 and is then attached to main housing 58 to form ground 56.

In the illustrated embodiment, switch housing 60 is mounted to main housing 58 with a rubber mounting assembly 62 that not only electrically isolates switch housing 60 from main housing 58 but also provides vibrational dampening.

It is noted that the placement of thermally responsive switch 44 in the line used to ground the magnetic switch controlling the energization of the solenoid differs from that of the starter assembly depicted in FIGS. 2 and 3. The location of the thermally responsive switch in the embodiment depicted in FIGS. 2 and 3 is between the voltage source 28 and ground 64 in the form of the vehicle frame. (Reference numeral 19 indicates this location in the schematic diagram of FIG. 8.) The location of thermally responsive switch 44 in the embodiment of FIGS. 5 and 8 provides several advantages. One of those advantages is that a non-standard two pin connector and modifications to the vehicles wiring harness are no longer required. Another advantage arises when using the thermally responsive switch with a microprocessor as will be discussed below.

The starter assembly 22 of FIGS. 5 and 8 also includes control circuitry 66 which includes a microprocessor 68. Control circuitry 66 is operably coupled with solenoid switch 40 whereby it can de-energize the coils of the magnetic switch forming solenoid switch 40 to thereby open solenoid switch 40 and thereby de-energize solenoid 34 and shift starter gear 30 to its disengaged position and de-energize electric motor 32. Provided that the user operated switch 54 remains closed, control circuitry 66 may selectively open and close solenoid switch 40. Control circuitry 66 includes a MOSFET switch 70 (FIG. 9) which is used to open and close electrical line 46 to thereby exercise this control of solenoid switch 40.

Figure 9:
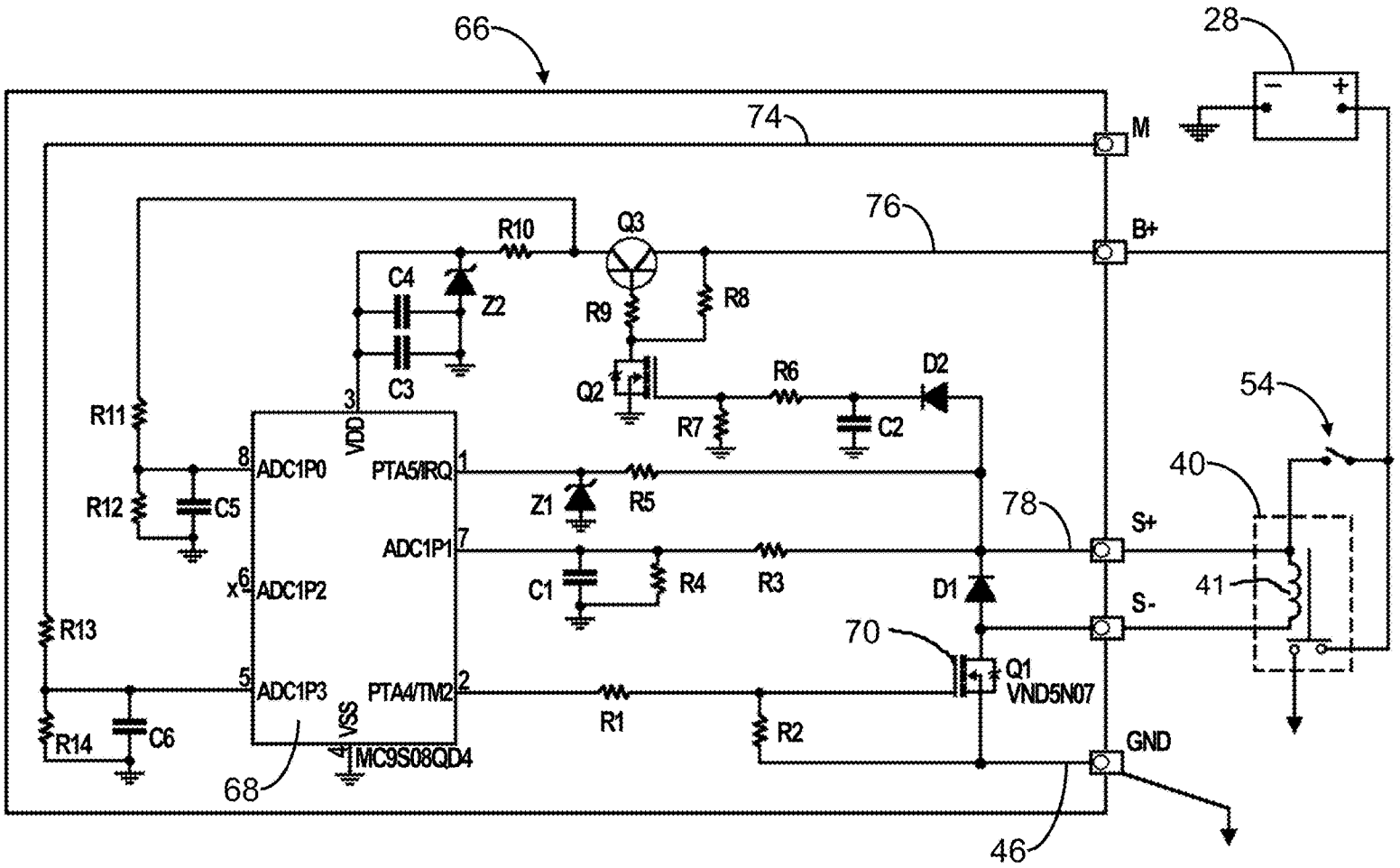
FIG. 9 is a schematic view of the control circuitry of the starter assembly of FIG. 5.

Control circuitry 66 is disposed within a control unit housing 72. Control unit housing is attached to switch housing 60 and a plurality of vibrational dampening and electrically isolating mounts form a mounting assembly 62 that is used to secure the control unit housing 72 and the switch housing 60 to the main housing 58. Isolating mounts 62 electrically isolate main housing 58 from both the control unit housing 72 and switch housing 60 which are attached to each other. Electrical line 46 is used to connect control circuitry 66 and electrical line 42 to a ground. In this regard, it is noted that several individual ground locations are shown in FIG. 9, these individual ground locations are all ultimately grounded through electrical line 46 and thermally responsive switch 44.

Control circuitry 66 is in communication with a motor voltage sensing line 74 whereby the control circuitry is responsive to voltage changes in the electrical motor. This can be accomplished with a line in communication with the M terminal of the starter assembly.

Control circuitry 66 is also in communication with an electrical line 76 in communication with the voltage source whereby the control circuitry is responsive to the voltage of the voltage source. This can be accomplished with a line in communication with the B+ terminal of the starter assembly.

Control circuitry 66 is also in communication with a sensing line 78 in communication with the electrical line in which the user-operated switch is located. This sensing line should sense the same voltage as the B+ terminal when the user-operated switch is closed. In other words, the voltage in this line corresponds to the voltage of the voltage source when the user operated switch is closed. This can be accomplished with a line in communication with the S+ terminal of the starter assembly.

The control circuitry is programmed to open the solenoid switch upon the satisfaction of predetermined conditions to thereby prevent damage to the electrical motor. More specifically, the control circuitry may be programmed to:

a) require a delay between sequential closings of the solenoid switch of at least three seconds (to thereby provide a rapid re-engagement lockout);

b) prevent the closing of the solenoid switch when the voltage of the voltage source exceeds a predetermined engine running voltage threshold (to thereby provide an engine running lockout);

c) prevent the closing of the solenoid switch if the voltage of the voltage source falls below a predefined first low voltage threshold (to thereby provide a low voltage lockout);

d) open the solenoid switch if the voltage of the voltage source falls below a predefined second low voltage threshold, the second low voltage threshold being lower than the first low voltage threshold (to thereby provide a low voltage lockout);

e) open the solenoid switch after passage of a predetermined time limit with the solenoid switch closed (to thereby provide a time-limited-crank function);

f) wherein the thermally responsive switch is disposed in a third electrical line and wherein the third electrical line also includes a user operated switch and, when the user operated switch is closed and the voltage of the electric motor falls below a predetermined threshold, the solenoid switch is momentarily opened and then closed and, if the voltage of the electric motor does not rise above the predetermined threshold and three such sequential opening and closing of the solenoid switch are conducted, the solenoid switch is opened (to thereby provide an auto-retry function); and g) wherein the control circuitry is responsive to the voltage in an electrical line containing the user operated switch and the solenoid switch is opened if, after closing the solenoid switch and energizing the solenoid, the voltage of the electrical line containing the user-operated switch rebounds above a predetermined threshold (to thereby provide an auto-disengage at start function).

These functions are also summarized in the chart provided in FIG. 10. It is further noted that U.S. Pat. No. 10,082,122 issued on Sep. 25, 2018 to Kirk entitled Starter System Having Controlling Relay Switch, the disclosure of which is incorporated herein by reference, provides a description of control circuitry and program logic that can be used with the present disclosure.

As evident from the functionality described above, control circuitry 66 is programmed to include several functions that operate to protect electric motor 32 against thermal damage. However, some of the functions provide functionality other than thermal protection. For example, the low-voltage lockout feature and engagement monitor/auto-retry feature provide benefits other than thermal protection. The inventors of the present application have recognized, however, that control circuitry 66 does have certain limitations. For example, while the circuit logic acts to prevent thermal damage based upon normal usage patterns, a user who repeatedly attempts to start an engine could repeat such attempts for such a large number of times that the electric motor is still subject to thermal damage even though each individual attempt was timed out by control circuitry 66. In the embodiment of FIGS. 5 and 8 which includes thermally responsive switch 44, however, switch 44 would open upon electric motor 32 being subjected to excessive heat to limit or prevent such thermal damage regardless of the sequence of user actions that occurred to create such a situation.

As mentioned above, control circuitry 66 includes a MOSFET switch 70 with MOSFET switch 70 being disposed in electrical line 46 which controls operation of solenoid switch 40. More specifically, MOSFET switch 70 is disposed in series with the coil of magnetic switch 40 and is located on the low side of this coil. Thermally responsive switch 44 is disposed in series with MOSFET switch 70 in electrical line 46 and opening of either MOSFET switch 70 or thermally responsive switch 44 prevents the grounding of the coil of switch 40 and thereby results in the opening of the solenoid switch 40. As can be seen in FIGS. 8 and 9, this arrangement is such that thermally responsive switch 44 is still operable to open electrical line 46 in the event of a short circuit of MOSFET switch 70 to a closed configuration.

While control circuitry 66 is considered robust, it is noted that MOSFET switch 70 does present a potential point of failure. When such MOSFET switches fail, they will typically short to a closed position. If MOSFET switch 70 does fail to a closed position, the starter assembly 22 depicted in FIGS. 5, 8 and 9 would still function as a manually actuated starter assembly but would not provide any of the protections afforded by the logic of control circuitry 66. However, thermally responsive switch 44 would still provide thermal protection for starter assembly 22 in the event of a short to closed position of MOSFET switch 70.

Figure 6:
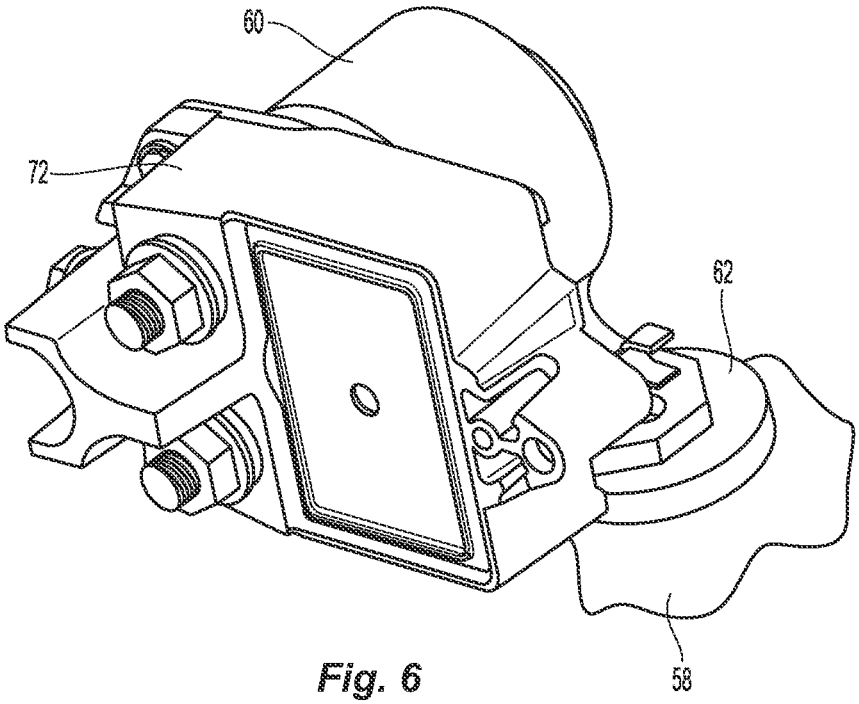
FIG. 6 is a perspective view of the magnetic switch housing and control circuitry housing of the starter assembly of FIG. 5
Figure 7:
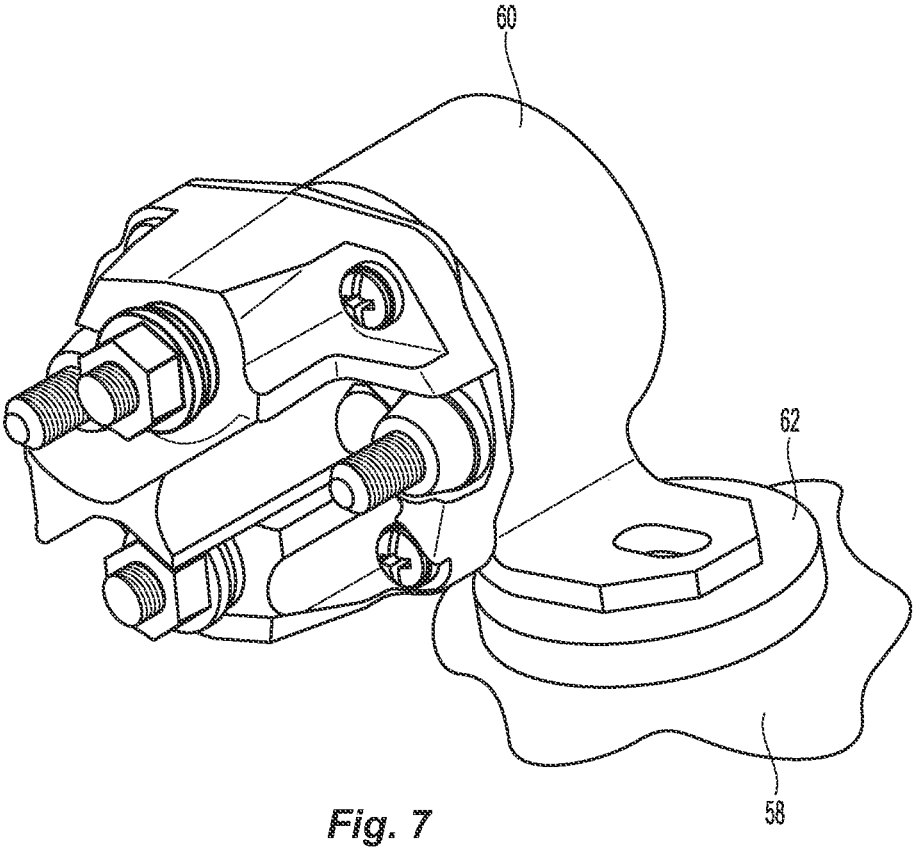
FIG. 7 is a perspective view of an alternative magnetic switch housing that can be used with the starter assembly of FIG. 5.

In this regard, it is noted that instead of using both a thermally responsive switch 44 and control circuitry 66, an alternative embodiment of starter assembly 22 could omit control circuitry 66 and rely solely on thermally responsive switch 44 in electrical line 46 connecting the coils of magnetic switch 40 to ground. In this regard, it is noted that FIG. 6 illustrates the combination of a switch housing 60 and control unit housing 72 used in the embodiment of FIG. 5. FIG. 7 corresponds to an alternative embodiment which does not include control circuitry 66 and has only a switch housing 60 mounted to main housing 58 using vibrational dampening and electrically isolating mounting assembly 62. In this regard, it is noted that switch housing 60 would be grounded to the main housing 58 through the extension of line 46 containing thermally responsive switch 44 in the same manner as the embodiment of FIGS. 5 and 8 which include control circuitry 66.

The starter assemblies described herein are well-suited for use with large vehicles and applications. The voltage sources of such applications may have a variety of different nominal voltages. For example, large trucks in the U.S. typically have 12 volt systems while those in Europe more commonly employ 24 volt systems and there is some indication that the trucking industry will move to 48 volt systems. Off-highway equipment is generally 24 volt globally. Diesel locomotive starters are typically 32 volt or 64 volt. The starting system described herein is suitable for use with all such nominal voltage systems as well as others which are not mentioned.

While the disclosed starter systems are particularly well-adapted for use with large vehicles/applications, they are not limited to any particular applications and may also be used in passenger vehicles and other light duty vehicles and applications. In this regard, it is noted that the disclosed starter assembly provides significant benefits in those vehicles/applications having relatively simple starter systems, such as those with only limited reliance on an ECU and/or which require a user operated switch to be closed to initiate a starter sequence, but may also be advantageously employed in vehicles/applications having more sophisticated starter systems having an ECU.

In the embodiments of FIGS. 5-9, thermally responsive switch 44 is a bimetallic switch which opens, to thereby disengage starter gear 30 and de-energize electric motor 32, at 150° C. and does not reclose until the switch has cooled to 130° C. This temperature range is well-suited for protecting electric machine 32 from thermal damage and is not directly dependent upon the nominal voltage of the system. While some applications may call for different temperature ranges, this would likely be due to differences in the physical size and capacity of the electric machine, the environment in which it is used, or some other factor.

While this invention has been described as having an exemplary design, the present invention may be further modified within the spirit and scope of this disclosure. This application is therefore intended to cover any variations, uses, or adaptations of the invention using its general principles.

What is claimed is:

1. A starter assembly for an internal combustion engine, the starter assembly adapted to work with a voltage source and the internal combustion engine to start the engine, the starter assembly comprising:

an electric motor which drives a starter gear, the starter gear being selectively shiftable between an engaged position and a disengaged position wherein in the starter gear is operably coupled with the internal combustion engine in the engaged position and is decoupled from the internal combustion engine in the disengaged position wherein the electric motor is mounted within a main housing, the main housing being grounded;

a solenoid coupled with the starter gear wherein energizing the solenoid shifts the starter gear into the engaged position and wherein the starter gear is biased to the disengaged position when the solenoid is de-energized; and wherein energizing the solenoid closes a motor switch, the motor switch being disposed in a first electrical line adapted to couple the electric motor with the voltage source whereby closing the motor switch energizes the electric motor and opening the motor switch de-energizes the electric motor;

a solenoid switch disposed in a second electrical line in communication with the solenoid wherein closing the solenoid switch energizes the solenoid and opening the solenoid switch de-energizes the solenoid wherein the solenoid switch is disposed in a switch housing, the switch housing being mounted on and electrically isolated from the main housing;

control circuitry including a microprocessor operably coupled with the solenoid switch, the control circuitry being in communication with a motor voltage sensing line whereby the control circuitry is responsive to voltage changes in the electrical motor, the control circuitry also being in communication with an electrical line in communication with the voltage source whereby the control circuitry is responsive to the voltage of the voltage source, the control circuitry being programmed to open the solenoid switch upon the satisfaction of predetermined conditions to thereby prevent damage to the electrical motor;

wherein the control circuitry is mounted within a control unit housing, the control unit housing being attached to the switch housing;

a vibrational dampening and electrically isolating mounting assembly for securing the control unit housing and the switch housing to the main housing wherein the mounting assembly electrically isolates the main housing from the control unit housing and from the switch housing; and a thermally responsive switch positioned to absorb heat generated by operation of the electric motor and wherein the thermally responsive switch opens when experiencing elevated temperatures, the thermally responsive switch being disposed in a third electrical line operably coupled with the solenoid switch wherein energizing the third electrical line closes the solenoid switch and de-energizing the third electrical line opens the solenoid switch, and wherein the third electrical line is grounded by attachment to the starter assembly, the thermally responsive switch being disposed in the third electrical line between the solenoid switch and the ground wherein opening of the thermally responsive switch prevents energizing of the third electrical line and results in the opening of the solenoid switch by opening the third electrical line and thereby preventing the grounding of the solenoid switch and the control circuitry.

2. The starter assembly of claim 1 wherein the third electrical line also includes a user operated switch.

3. The starter assembly of claim 1 wherein the solenoid switch is a magnetic switch and the third electrical line forms coils of the magnetic switch.

4. The starter assembly of claim 3 wherein the third electrical line includes a user operated switch and extends, in series, from the voltage source to the user operated switch, to the magnetic switch, to the thermally responsive switch, to a ground.

5. The starter assembly of claim 3 wherein the thermally responsive switch is disposed in the third line between the switch housing and the main housing.

6. The starter of claim 1 wherein the thermally responsive switch is a bimetallic switch.

7. The starter system of claim 1 wherein the thermally responsive switch is mounted on and absorbs heat from the brush plate assembly of the electric motor.

8. The starter assembly of claim 1 wherein the control circuitry includes a MOSFET switch, the MOSFET switch being disposed in the third electrical line controlling operation of the solenoid switch wherein opening of the thermally responsive switch results in the opening of the solenoid switch, the MOSFET switch being disposed in series with the thermally responsive switch.

9. The starter assembly of claim 8 wherein the thermally responsive switch is operable to open the electrical line controlling the operation of the solenoid switch in the event of a short circuit of the MOSFET switch to a closed configuration.

10. The starter assembly of claim 9 wherein the control circuitry is programmed to:

a) require a delay between sequential closings of the solenoid switch of at least three seconds;

b) prevent the closing of the solenoid switch when the voltage of the voltage source exceeds a predetermined engine running voltage threshold;

c) prevent the closing of the solenoid switch if the voltage of the voltage source falls below a predefined first low voltage threshold;

d) open the solenoid switch if the voltage of the voltage source falls below a predefined second low voltage threshold, the second low voltage threshold being lower than the first low voltage threshold;

e) open the solenoid switch after passage of a predetermined time limit with the solenoid switch closed;

f) wherein the thermally responsive switch is disposed in the third electrical line and wherein the third electrical line also includes a user operated switch and, when the user operated switch is closed and the voltage of the electric motor falls below a predetermined threshold, the solenoid switch is momentarily opened and then closed and, if the voltage of the electric motor does not rise above the predetermined threshold and three such sequential opening and closing of the solenoid switch are conducted, the solenoid switch is opened; and g) wherein the control circuitry is responsive to the voltage in an electrical line containing the user operated switch and the solenoid switch is opened if, after closing the solenoid switch and energizing the solenoid, the voltage of the electrical line containing the user-operated switch rebounds above a predetermined threshold.

11. The starter assembly of claim 10 wherein the user operated switch is required to be closed to close the solenoid switch.

12. The starter system of claim 1 wherein the thermally responsive switch is a bimetallic switch and the third electrical line also includes a user operated switch;

wherein the solenoid switch is a magnetic switch and the third electrical line forms coils of the magnetic switch and extends, in series, from the voltage source to the user operated switch, to the magnetic switch, to the thermally responsive switch, to a ground; and wherein the third electrical line is grounded by connecting it to the main housing, the thermally responsive switch being disposed in the third line between the switch housing and the main housing.

13. The starter assembly of claim 12 wherein the control circuitry includes a MOSFET switch, the MOSFET switch being disposed in the third electrical line controlling operation of the solenoid switch wherein opening of the thermally responsive switch results in the opening of the solenoid switch, the MOSFET switch being disposed in series with the thermally responsive switch.

14. The starter assembly of claim 13 wherein the thermally responsive switch is still operable to open the third electrical line controlling the operation of the solenoid switch in the event of a short circuit of the MOSFET switch to a closed configuration.

15. The starter assembly of claim 14 wherein the control circuitry is programmed to:

a) require a delay between sequential closings of the solenoid switch of at least three seconds;

b) prevent the closing of the solenoid switch when the voltage of the voltage source exceeds a predetermined engine running voltage threshold;

c) prevent the closing of the solenoid switch if the voltage of the voltage source falls below a predefined first low voltage threshold;

d) open the solenoid switch if the voltage of the voltage source falls below a predefined second low voltage threshold, the second low voltage threshold being lower than the first low voltage threshold;

e) open the solenoid switch after passage of a predetermined time limit with the solenoid switch closed;

f) wherein the thermally responsive switch is disposed in the third electrical line and wherein the third electrical line also includes a user operated switch and, when the user operated switch is closed and the voltage of the electric motor falls below a predetermined threshold, the solenoid switch is momentarily opened and then closed and, if the voltage of the electric motor does not rise above the predetermined threshold and three such sequential opening and closing of the solenoid switch are conducted, the solenoid switch is opened; and g) wherein the control circuitry is responsive to the voltage in an electrical line containing the user operated switch and the solenoid switch is opened if, after closing the solenoid switch and energizing the solenoid, the voltage of the electrical line containing the user-operated switch rebounds above a predetermined threshold.

16. The starter assembly of claim 15 wherein the user operated switch must be closed to close the solenoid switch.

* * * * *